US007337765B2

(12) United States Patent
Tanaka et al.

(10) Patent No.: US 7,337,765 B2
(45) Date of Patent: Mar. 4, 2008

(54) THROTTLE REGULATOR FOR VIBRATION COMPACTION MACHINE

(75) Inventors: Giichi Tanaka, Shiraoka-machi (JP); Yoshinori Harashima, Satte (JP); Kenichi Nagasawa, Hasuda (JP); Kenichi Muramoto, Shiraoka-machi (JP)

(73) Assignee: Mikasa Sangyo Co., Ltd., Tokyo (JP)

( * ) Notice: Subject to any disclaimer, the term of this patent is extended or adjusted under 35 U.S.C. 154(b) by 0 days.

(21) Appl. No.: 11/651,679

(22) Filed: Jan. 10, 2007

(65) Prior Publication Data

US 2007/0234999 A1 Oct. 11, 2007

(30) Foreign Application Priority Data

Apr. 11, 2006 (JP) ..... 2006-108390

(51) Int. Cl.
*F02D 11/02* (2006.01)
*F02D 11/04* (2006.01)

(52) U.S. Cl. ..... 123/400; 123/198 DB; 123/198 DC

(58) Field of Classification Search ..... 123/376, 123/397, 400, 198 DB, 198 DC
See application file for complete search history.

(56) References Cited

U.S. PATENT DOCUMENTS 6,363,911 B1 * 4/2002 Reinhardt et al. ..... 123/397
6,516,779 B2 * 2/2003 Ikeda ..... 123/400
2006/0219218 A1 * 10/2006 Yuasa ..... 123/396

FOREIGN PATENT DOCUMENTS

| | | |
|---|---|---|
| JP | 09-195855 A | 7/1997 |
| JP | 3053245 U | 8/1998 |
| JP | 2001-200734 A | 7/2001 |

* cited by examiner

*Primary Examiner*—Erick Solis
(74) *Attorney, Agent, or Firm*—Frishauf, Holtz, Goodman & Chick, P.C.

(57) ABSTRACT

An engine stop switch and a fuel open-close lock are accommodated in a throttle lever case so that they can be easily disassembled, and the engine stop switch is turned on and off and the fuel open-close cock is opened and closed adequately by the actuation of a rotary valve in response to the turning of a lever. An engine stop switch and a fuel open-close lock are integrally incorporated in a throttle lever case, a partially toothless driven gear is intermittently rotated via a partially toothless drive gear rotated by a lever, and the intermittent rotation of the partially toothless driven gear turns on/off the engine stop switch and opens/closes the fuel open/close cock.

11 Claims, 6 Drawing Sheets

THROTTLE REGULATOR FOR VIBRATION COMPACTION MACHINE

BACKGROUND OF THE INVENTION

1. Field of the Invention

The present invention relates to the improvement of a throttle regulator for use in a vibration compaction machine such as a rammer, for compacting a road surface by hitting the road surface with a compaction plate that moves up and down.

2. Description of the Related Art

A vibration compaction machine such as a rammer is loaded on a vehicle and transported before the operation is started and after the operation is completed, but if the machine is loaded in a sidewise state, there is a risk of the fuel leaking from a fuel tank into a carburetor and causing an accident by ignition and explosion.

To resolve this problem, in prior art, a structure was disclosed in which once the compaction machine has ended the operation and an engine has been stopped by manipulating a throttle lever, a channel for supplying a fuel from a fuel tank to the engine was automatically closed to cut off the fuel leak. As a result, the occurrence of accidents associated with fuel leak could be prevented.

Such throttle regulators are configured so that fuel leak can be prevented by actuating an engine stop switch and a fuel cock by turning a throttle lever, but the problem associated with the conventional throttle regulators is that the engine stop switch, fuel cock, and throttle lever speed regulation mechanism are not provided together on a manipulation handle of a compaction machine so that they can be easily enabled by a operator. As a result, the engine stop switch and fuel cock can hardly function adequately.

For example, in the throttle regulator described in Japanese Patent Application Laid-open No. 9-195855, the fuel cock valve mechanism is directly connected to the throttle lever, but the engine stop switch is provided so as to be actuated by a push-button switch that is operated by a wire attached in a position separate from that of a wire for turning the throttle lever, for example, on the engine body side. The resultant problem is that the push-button switch cannot be enabled unless the wire for the turning manipulation of the throttle lever is smoothly actuated.

In the throttle regulator of Japanese Patent Applications Laid-open No. 2001-200734, various units such as a throttle mechanism, an engine stop switch, a fuel cock valve mechanism, and a fuel tank inner pressure release valve are configured by using a fuel tank as the base component. As a result, such units as the throttle mechanism and engine stop switch are provided on the surface of the fuel tank that is easily contaminated at all times with dust or the like. On the other hand, the fuel cock valve mechanism and fuel tank inner pressure release valve are provided inside the fuel tank that cannot be easily disassembled and, therefore, those mechanisms are difficult to maintain. Yet another problem is that because the surface of the fuel tank is positioned in the zone above the operation handle, one-hand operation is performed when the throttle lever is manipulated, and the units are difficult to manipulate.

Furthermore, in the throttle regulators described in Japanese Patent Applications Laid-open No. 9-195855 and 2001-200734, piston-type valves are used as the fuel cock valve mechanism and, therefore, one of the open-closing operations in the valve mechanism relies upon a spring force. However, when such piston-type valve mechanism relying upon a spring force is used over a long period, the fuel that adhered to the valve mechanism is converted into a resinous substance that causes malfunction in the opening-closing operation of the valve and also a valve seal surface is damaged due to the adhesion of foreign matter or the like.

SUMMARY OF THE INVENTION

It is an object of the present invention to provide a throttle regulator in which an engine stop switch and a fuel open-close cock are accommodated inside a throttle lever case in a state allowing them to be disassembled at any time and in which an on-off operation of an ignition circuit and an open-close operation of the fuel open-close cock are performed adequately by rotary-type valve actuation in response to the turning of a lever, this throttle regulator serving as means for resolving the problems associated with the conventional throttle regulators used in vibration compaction machines.

As a specific means for attaining the above-described object the present invention provides a throttle regulator for a vibration compaction machine in which an engine stop switch and a fuel open-close cock are integrally incorporated in a throttle lever case, wherein the engine stop switch and fuel open-close cock are disposed so as to be actuated by the rotation of a partially toothless driven gear disposed in the lever case, and a lever turning shaft located inside the lever case also comprises a partially toothless drive gear that engages intermittently with the partially toothless driven gear.

Within a range in which the lever is turned from an engine stop position to an idling position and a range in which the lever is turned from the idling position to the engine stop position, the partially toothless driven gear is rotated by a predetermined angle by the rotation of the partially toothless drive gear and an opening and closing operation of the fuel open-close cock and an on-off operation of the engine stop switch are performed.

Furthermore, within a range in which the lever is turned from the idling position to a throttle full-open position and within a range in which the lever is turned from the throttle full-open position to the idling position, an engagement of a tooth of the partially toothless drive gear and a tooth of the partially toothless driven gear is released, the rotation of the partially toothless driven gear is stopped, and position in which the engine stop switch is on and the fuel open-close cock is open is maintained.

A base end section of a circular-arc plate spring comprising a V-shaped locking section at a distal end thereof is fixed to an outer peripheral surface of a partially toothless driven gear for actuating an engine stop switch and a fuel open-close cock, a circular-arc guiding wall is provided on the inner surface of a case along the outer peripheral surface of the partially toothless driven gear, and when the engagement of a tooth of a partially toothless drive gear and a tooth of the partially toothless driven gear is released and the rotation of the partially toothless driven gear is stopped, the V-shaped locking section located at the distal end of the plate spring is engaged with a step formed by an end section of the circular-arc guiding wall and the inner surface of the case and the independent rotation of the partially toothless driven gear can be prevented.

The partially toothless drive gear for intermittent engagement with the partially toothless driven gear is fit onto a lever rotary shaft located inside the lever case, the drive gear is fit on the shaft inside the case so that the lever can be stationary located in predetermined speed regulation positions including an engine stop position and an idling position, and when the lever is turned from the idling position in the direction of a throttle full-open position, an arm provided at the drive gear moves a distal end section of a throttle wire introduced into the case in the turning direction of the lever.

A partially toothless drive gear that is rotated by a lever is supported on a rotary shaft inside a case member via a latch structure in which a steel ball protruding at one side surface is fit and pushed into a latch hole on an inner surface of the case by a spring pressure, a pushing force of the spring acting on said steel ball is provided by sandwiching the rotary shaft between left and right case members, whereas a tightening force necessary for the turning operation of the lever that is fit onto a rotary shaft is provided to the lever via a force by which a bolt head screwed into a rotary shaft pushes a disk spring.

The throttle regulator in accordance with the present invention has a structure in which the on-off operation of the engine stop switch and the open-close operation of the fuel open-close cock are performed by the rotation of the partially toothless driven gear that is intermittently rotated in response to the turning of the throttle lever. Therefore, the engine stop switch and fuel open-close cock that are actuated by rotation can be disposed as independent parts on the same shaft of the partially toothless driven gear, those parts can be accommodated in a compact configuration that can be disassembled at all times inside the throttle lever case, the case can be attached in a position where one corner of the operation handle is easily manipulated, and if necessary, disassembling, repair, and maintenance can be easily performed.

Furthermore, because opening-closing operations of the fuel cock valve are forcibly performed by the rotation of the partially toothless driven gear that is intermittently rotated in response to the turning of the lever, it is possible to resolve adequately the problems associated with incorrect actuation of the valve caused by the conversion of fuel into a resinous substance or damage of the valve seal surface by the admixing and adhesion of foreign matter, as in a push-button fuel cock valve using the resilience of a spring that is installed in the conventional apparatuses of this type.

Where a structure is used in which a base end section of a circular-arc plate spring comprising a V-shaped locking section at a distal end thereof is fixed to an outer peripheral surface of a partially toothless driven gear that is rotated intermittently for actuating an engine stop switch and a fuel open-close cock and a circular-arc guiding wall over which the distal end of the plate spring slides is provided on the inner surface of a case along the outer peripheral surface of the partially toothless driven gear, when the engagement of a tooth of a partially toothless drive gear and a tooth of the partially toothless driven gear is released and the rotation of the partially toothless driven gear is stopped, the V-shaped locking section located at the distal end of the plate spring is engaged with a step formed by an end section of the circular-arc guiding wall and the inner surface of the case, the independent rotation of the partially toothless driven gear can be prevented, and accuracy can be increased even when the partially toothless driven gear is subjected to impacts.

In order to clarify the state in which the throttle lever is in an engine stop position, idling position, or throttle full-open position, the partially toothless drive gear is fit onto a shaft with a latch structure in which a steel ball protruding at one side surface is pushed into a latch hole on an inner surface of the case by a spring pressure, and pushing forces are provided by independent means, that is, a pushing force of the spring acting on the steel ball is provided by sandwiching the partially toothless drive gear between the left and right side surfaces of the case, whereas a tightening force necessary for the turning operation of the lever that is fit onto a rotary shaft of the drive gear is provided to the lever by a force by which a bolt head screwed into a rotary shaft of the drive gear pushes a disk spring. Therefore, the tightening force of the throttle lever can be regulated in a simple manner, independently of the pushing pressure of the latch structure.

DESCRIPTION OF THE PREFERRED EMBODIMENTS

When the throttle regulator is implemented, the units such as the engine stop switch and fuel open-close cock are configured as independently sealed parts so as to prevent the erroneous actuation caused by dust or freezing and with consideration for problems associated with fuel leak or the like, and it is preferred that a sealed structure be obtained by employing an O ring or another sealing material inside the case.

Embodiments

The configuration of the throttle regulator in accordance with the present invention will be described below based on embodiment thereof illustrated by FIG. 1.

Figure 1:
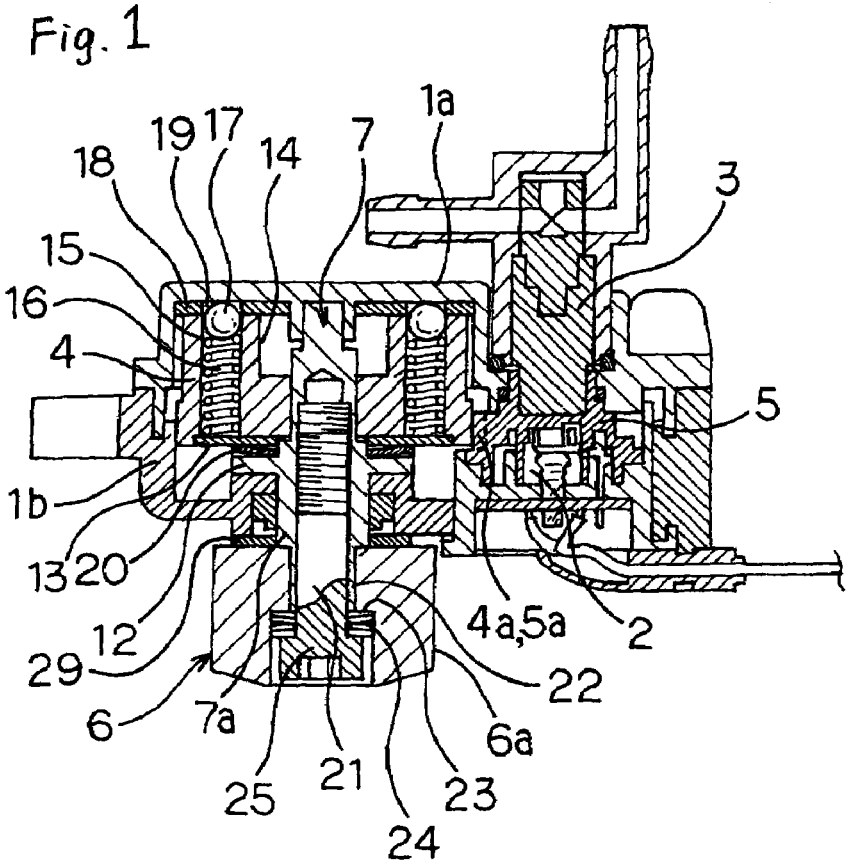
FIG. 1 is a cross-sectional view illustrating the basic configuration of the throttle regulator in accordance with the present invention.

FIG. 1 is a cross-sectional view illustrating the configuration of the regulator. In this regulator, an engine stop switch 2, a fuel open-close cock 3, and an partially toothless drive gear 4 and a partially toothless driven gear 5 for actuating those stop switch 2 and open-close cock 3 are accommodated in part of a case 1 formed by joining together a pair of left and right case members 1*a*, 1*b*.

Figure 3:
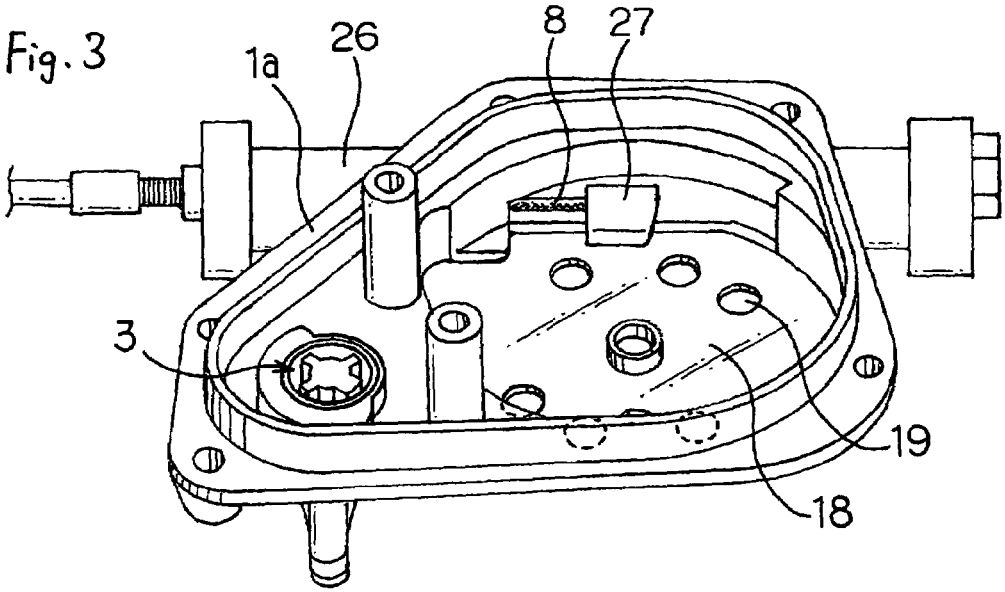
FIG. 3 is a perspective view illustrating the shape of another case member to be joined to the case member shown in FIG. 2.

A rotary shaft 7 of a throttle lever 6 with a base end section 7*a* having a cylindrical shape is inserted into the case member 1*b*, and the partially toothless drive gear 4 is fit onto the distal end of the rotary shaft 7. Furthermore, a base shaft section 6*a* of the lever 6 is also fit onto the rotary shaft 7. When the lever 6 is turned in the left-right direction, as shown in FIG. 1, about the rotary shaft 7, a throttle wire 8 shown in FIG. 3 is pulled in, whereby a throttle regulator function is demonstrated.

Figure 2:
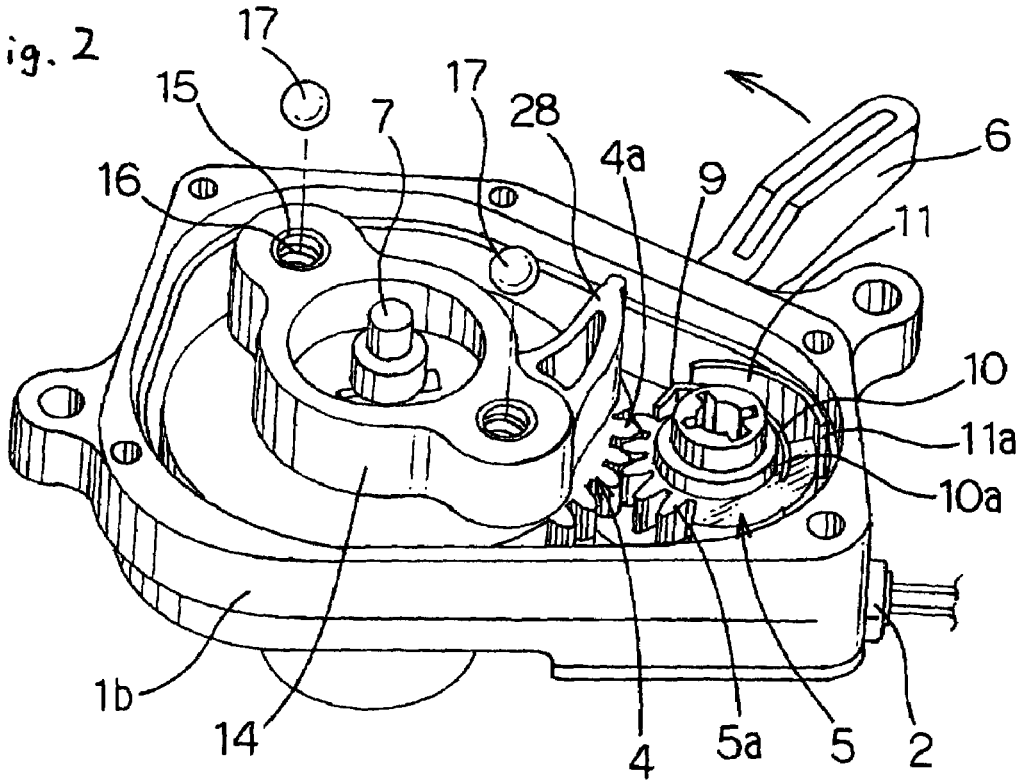
FIG. 2 is a perspective view illustrating the internal shape of one case member in the engine stop position.

As shown in FIG. 2, in the partially toothless drive gear 4 fitted on the rotary shaft 7 inside the case member 1*b*, teeth 4*a* are provided only on part of the circumferential surface, and a partially toothless driven gear 5 comprising teeth 5*a* for intermittent engagement with the teeth 4*a* of the partially toothless drive gear 4 at part of the circumferential surface is provided in one corner inside the case member 1*a*.

Figure 4:
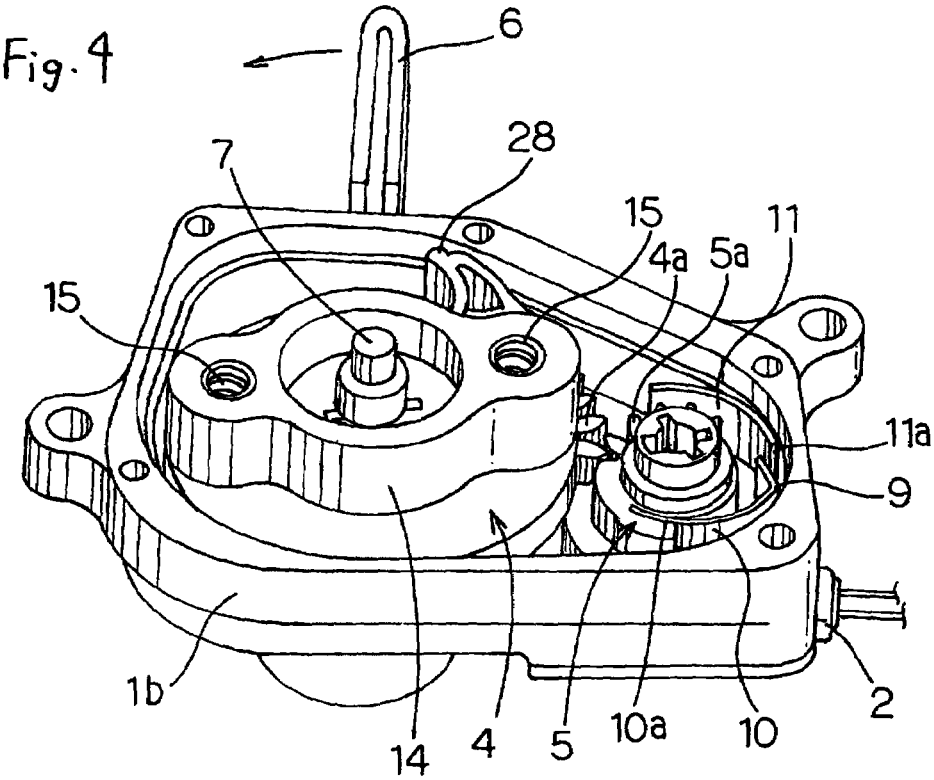
FIG. 4 is a perspective view illustrating the internal shape of the same case member as shown in FIG. 2 in a state where the lever is in the idling position.
Figure 5:
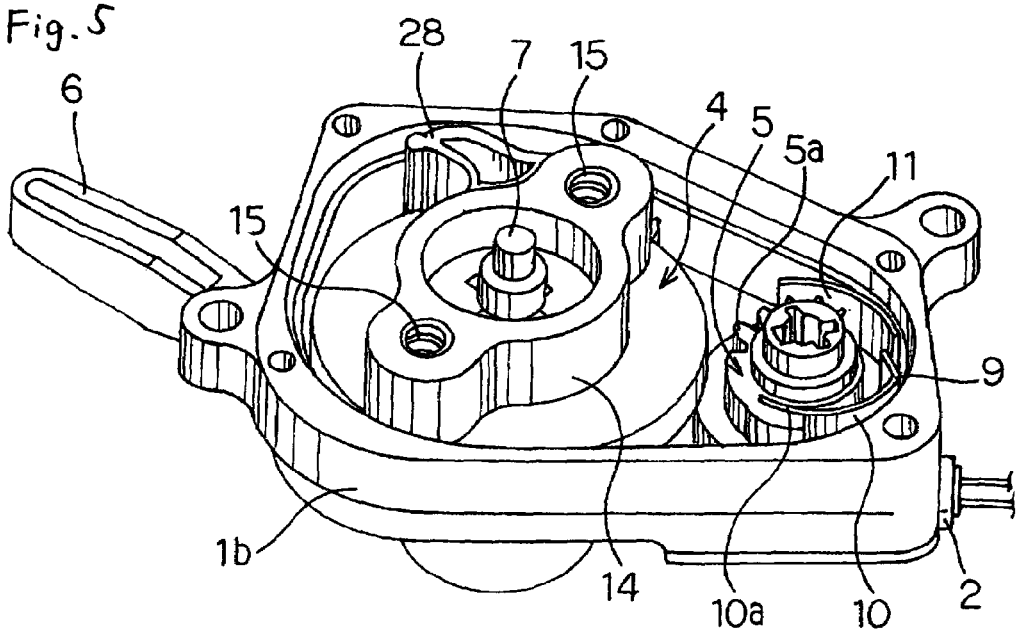
FIG. 5 is a perspective view illustrating the internal shape of the same case member as shown in FIG. 2 in a state where the lever is in the throttle full-open position.

The position of the lever 6 shown in FIG. 2 is assumed to be an engine stop position, and when the lever 6 is turned in the direction of idling position shown by an arrow, the driven gear 5 is rotated in the clockwise direction by the drive gear 4 to the predetermined angular position, but when the drive gear 4 reaches an angle of disengagement from the driven gear 5 in the process of counterclockwise rotation, as shown in FIG. 4, only the drive gear 4 rotates and the driven gear 5 stops rotating in the opposition of separation from the drive gear 4.

Of the upper and lower ends of the partially toothless driven gear 5, as shown in FIG. 1, the fuel open-close cock 3 is provided at the upper end of the driven gear 5 and the engine stop switch 2 that is reliably sealed on the outer side is provided at the lower end. As shown in FIG. 2, when the position of the lever 6 is the engine stop position, the engine stop switch 2 provided at the lower end of the partially toothless driven gear 5 maintains an OFF state, and the fuel open-close cock 3 provided at the upper end maintains a closed state.

When the lever 6 is turned in the idling position direction, as shown in FIG. 4, from the state in which the engine stop switch 2 is OFF and the fuel open-close cock 3 is closed, which is shown in FIG. 2, the driven gear 5 rotates to the predetermined angular position following the rotation of the drive gear 4, the engine stop switch 2 assumes an ON state, the fuel open-close cock 3 assumes a closed state, and after the engine has been started, the partially toothless driven gear 5 does not rotate in this position and the rotation of engine and supply of fuel are continued.

A base end section 10*a* of a circular-arc plate spring 10 comprising a V-shaped locking section 9 at the distal end is fixedly attached to the outer peripheral surface of the partially toothless driven gear 5, and a circular-arc guiding wall 11 along which the V-shaped locking section 9 of the plate spring 10 slides is provided on the inner surface of the case 1*a* along the outer peripheral surface of the partially toothless driven gear 5, so that the state in which the engine stop switch 2 is ON and the fuel open-close cock 3 is closed can be maintained after the partially toothless driven gear 5 has stopped in the predetermined angular position.

As a result, as shown in FIG. 2, when the lever 6 is turned from the engine stop position in the direction of the idling position to rotate the drive gear 4 and rotate the driven gear 5 in the clockwise direction, the locking section 9 on the distal end of the plate spring 10 slides along the circular-arc inner peripheral surface of the guiding wall 11, while receiving a contact pressure therefrom.

Furthermore, as shown in FIG. 4, when the rotation of drive gear 4 advances, the engagement of the drive gear 4 and driven gear 5 is released, and the driven gear 5 reaches an angle at which the rotation thereof is stopped, the V-shaped locking section 9 located at the distal end of the plate spring 10 engages with a step 11*a* between the end section of the guiding wall 11 and the inner surface 1*a* of the case, and the partially toothless driven gear 5 stops so as not to rotate independently till the next rotation force acts thereupon.

On the other hand, as shown in FIG. 1 and FIG. 2, the partially toothless drive gear 4 is fitted on the rotary shaft 7 that is provided in a vertical state inside the case member 1*b*, but the drive gear 4 is fitted so as to be supported by s backup plate 13 held on a flange 12 of the rotary shaft 7.

Furthermore, a protruding section 14 that will serve for joining to the case member 1*a* that will be fit on the other end of the rotary shaft 7 is provided at the upper surface of the drive gear 4. This protruding section 14 has a pair of holes 15 that have the same axial direction as the rotary shaft 7 in the positions symmetrical with respect to the rotary shaft 7 as a center, coil springs 16 supported at the lower ends thereof by the backup plate 13 are inserted into the holes 15, and steel balls 17 are disposed at the top ends of the coil springs 16.

As shown in FIG. 3, an angle control plate 18 for holding the rotation angle of the partially toothless drive gear 4 in the predetermined angular position is provided on the inner side of the case member 1*a* into which the protruding section 14 of the drive gear 4 will be inserted. A plurality of latch holes 19 for inserting the steel balls 17 disposed at the upper ends of holes 15 and receiving the force of coil springs 16 accommodated inside the holes 15 of the protruding section 14 are set in the angle control plate 18 in the predetermined angular positions that were set in advance.

Figure 11:
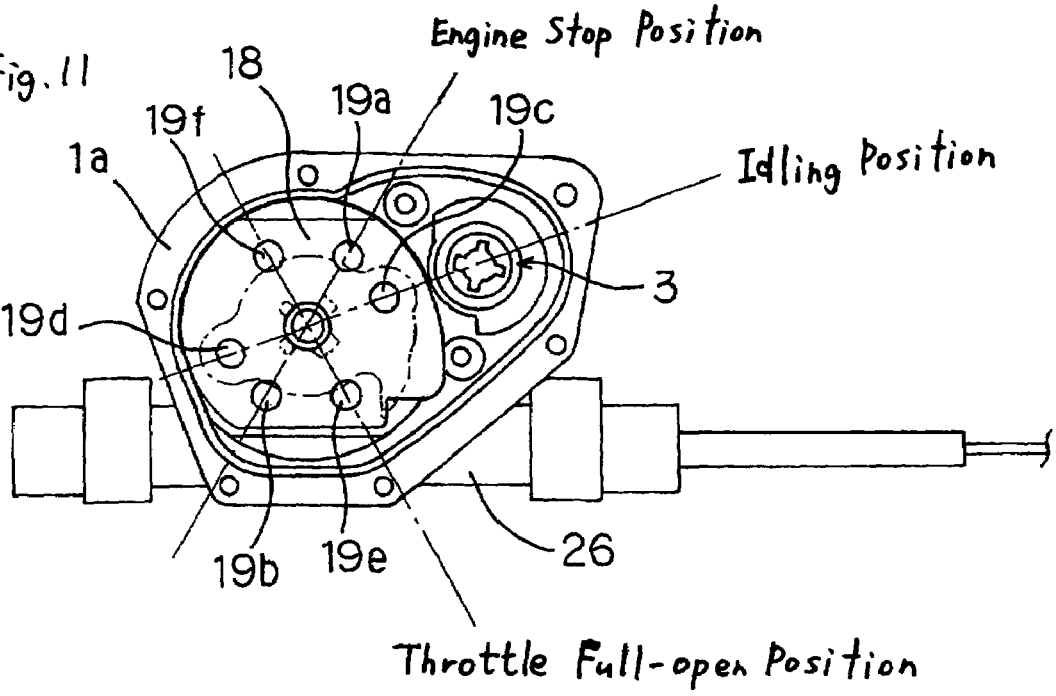
FIG. 11 is a plan view illustrating the relationship between the latch hole of an angle control plate provided inside one case and the angle holding position of the lever.

The angular positions of the latch holes 19 are set, for example so, as shown in FIG. 11, that the position in which the steel balls 17 of the protruding section 14 are fit into the latch holes 19*a*, 19*b* corresponds to the engine stop position, the position in which the steel balls 17 are fit into the latch holes 19*c*, 19*d* corresponds to the idling position, and the position in which the steel balls 17 are fitted into the latch holes 19*e*, 19*f* corresponds to a throttle full-open position.

As shown in FIG. 1, when the case member 1*a* is joined to the case member 1*b*, the partially toothless drive gear 4 comprising the protruding section 14 receives a force by which the coil springs 16 supported at one end thereof by the backup plate 13 are compressed in the direction of the backup plate 13 via the steel balls 17 and a force by which the backup plate 13 supported by the flange 12 of the rotary shaft 7 is compressed in the direction of the backup plate 13 by the disk spring 20 disposed between the backup plate and the flange 12, those two forces being well balanced. As a result, the partially toothless drive gear 4 can be smoothly rotated toward the predetermined angular position by the operation of the lever 6.

On the other hand, a bolt insertion hole 22 is opened in the base end section 6*a* of the throttle lever 6, and a bolt 21 for fitting the lever 6 on the rotary shaft 7 is inserted into the insertion hole 22. Furthermore, a step 23 with a diameter of the surface side larger than the diameter of the inner side is provided inside the bolt insertion hole 22, and when the bolt 21 is inserted, a disk spring 24 is placed on the step 23 and the bolt is screwed into the rotary shaft 7 by a threaded section at the distal end thereof, while the disk spring 24 is compressed by the bolt head 25. In FIG. 1, the reference numeral 29 stands for a washer.

When the bolt 21 is fitted into the rotary shaft 7 through the insertion hole 22 of the lever 6, the compressive force applied by the bolt head 25 to the disk spring 24 can be appropriately adjusted by the operator. This adjustment can be performed independently of the pushing force applied to the steel balls 17 located on the protruding section 14 of the partially toothless drive gear 4. The resultant advantage is that the adjustment can be handled easily.

As shown in FIG. 3, a throttle wire introduction channel 26 is provided in the case member 1*a*, and a distal end section 27 of a wire 8 is positioned via this introduction channel 26 at the outer peripheral edge of the drive gear 4. Furthermore, as shown in FIG. 2, an arm 28 for pulling the wire 8 in the throttle full-open direction by engagement with the distal end section 27 of the wire 8 in the course of the rotation of the drive gear 4 is provided on the side surface of the protruding section 14 that protrudes upward from the drive gear 4.

Figure 6:
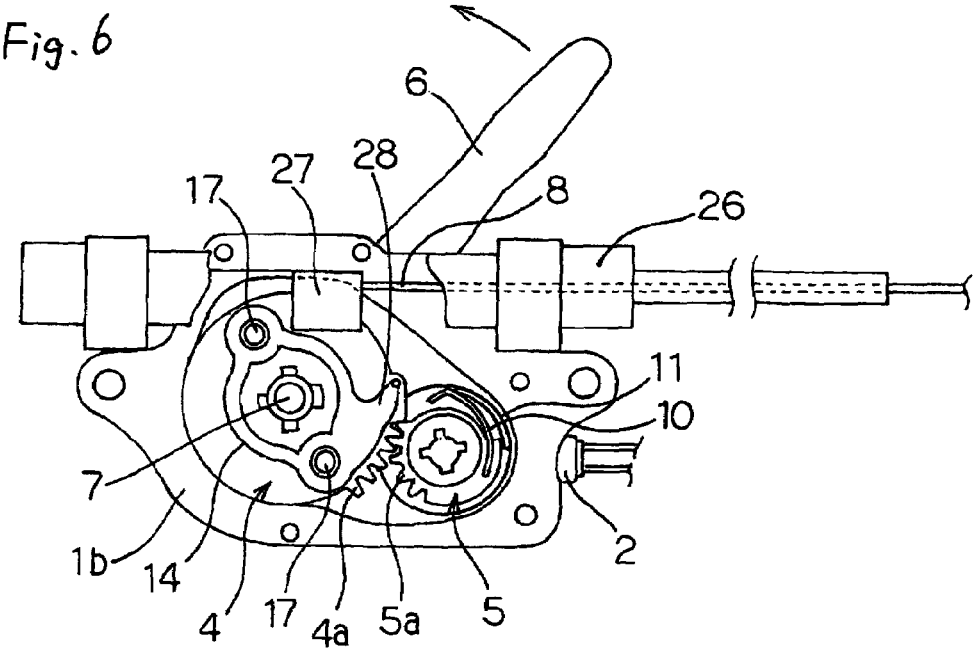
FIG. 6 is a plan view illustrating the internal shape of the same case member as shown in FIG. 2 in a state where the lever is in the engine stop position.

The actuation of the above-described apparatus will be described below with reference to FIGS. 6 through 10. FIG. 6 shows a state in which the throttle lever 6 is in the engine stop position. At this time, the teeth 4*a* of the drive gear 4 are engaged with the teeth 5*a* of the driven gear 5 and the driven gear 5 rotates in the clockwise direction, whereby the engine stop switch 2 is turned off and the fuel open-close cock 3 is closed. When the lever 6 is in the engine stop position, the steel balls 17 of the drive gear 4 are fitted in the latch holes 19*a*, 19*b* of the angle control plate 18 shown in FIG. 11 and this position is held.

Figure 7:
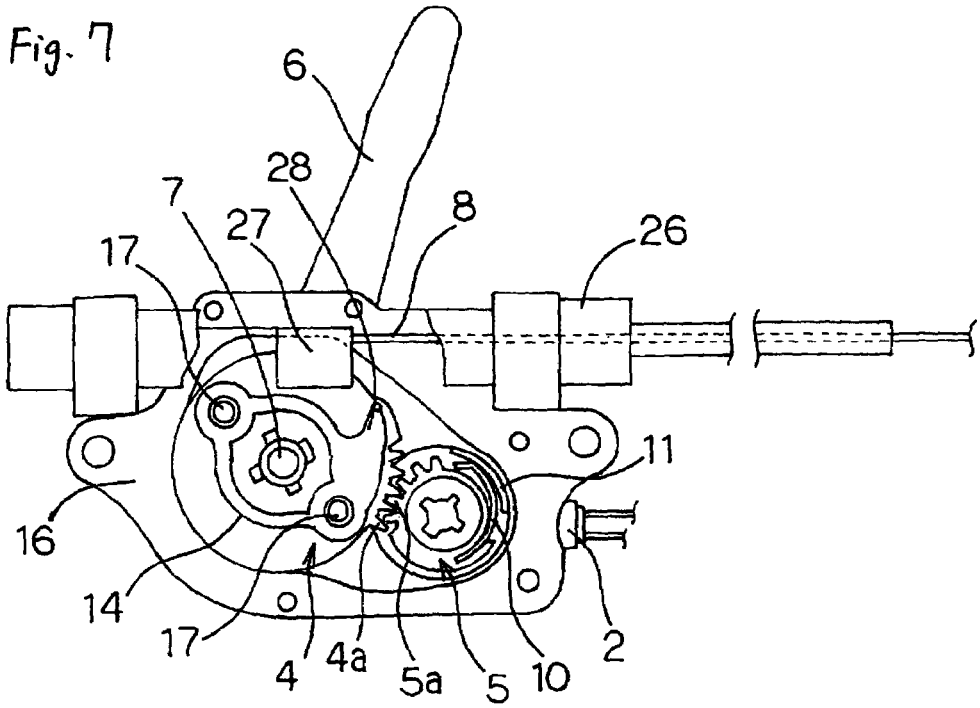
FIG. 7 is a plan view illustrating the internal shape of the same case member as shown in FIG. 6 in a state where the lever is in an intermediate position between the engine stop position and idling position.

When the lever 6 is turned from the position shown in FIG. 6 into the position shown in FIG. 7, the drive gear 4 rotates in the counterclockwise direction, the driven gear 5 rotates in the clockwise direction, and the engine stop switch 2 maintains the OFF state thereof, but the fuel open-close cock 3 is opened and the fuel is supplied to the carburetor. During such rotation of the driven gear 5, the locking section 9 at the distal end of the plate spring 10 provided in the driven gear 5 slides in contact with the circular-arc inner peripheral surface of the guiding wall 11. The arm 28 of the protruding section 14 of the drive gear is yet to come into contact with the distal end section 27 of the throttle wire 8 at this rotation angle.

Figure 8:
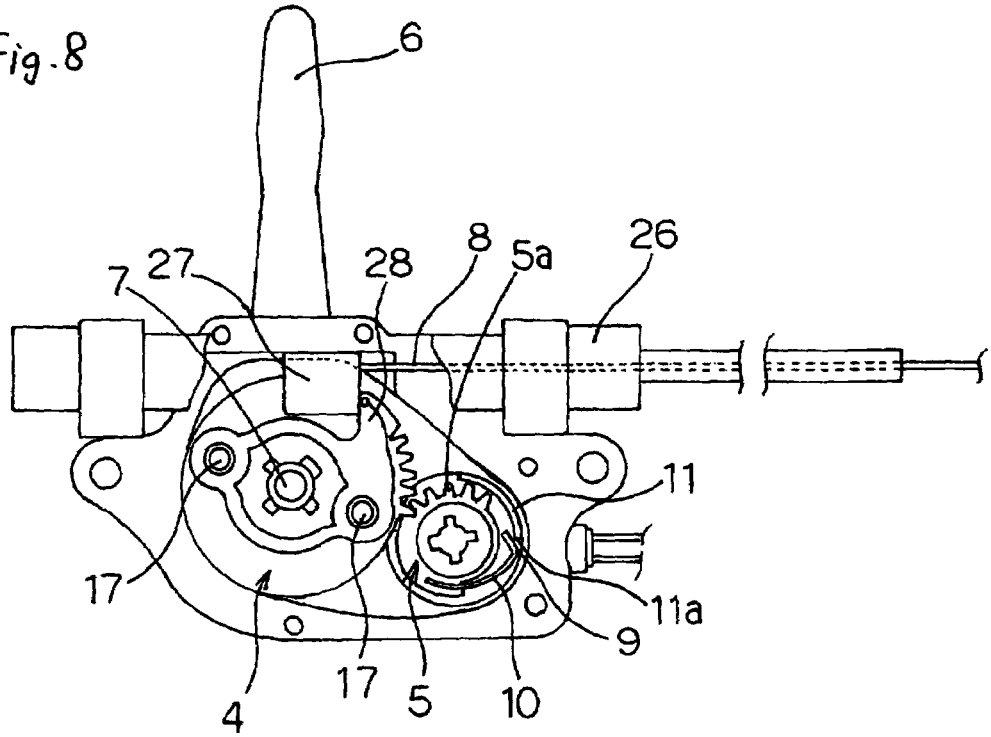
FIG. 8 is a plan view illustrating the internal shape of the same case member as shown in FIG. 6 in a state where the lever is in the idling position.

If the lever 6 is then turned into the position shown in FIG. 8, the rotation angle of the driven gear 5 further advances, the engine stop switch 2 is turned on, the fuel open-close cock 3 is opened, and the engine can be started. At this time, the arm 28 of the protruding section 14 of the driver gear comes into contact with the distal end section 27 of the throttle wire. Furthermore, the steel balls 17 of the drive gear 4 are fitted into the latch holes 19*c*, 19*d* of the angle control plate 18 shown in FIG. 11, whereby the idling position is held.

Figure 9:
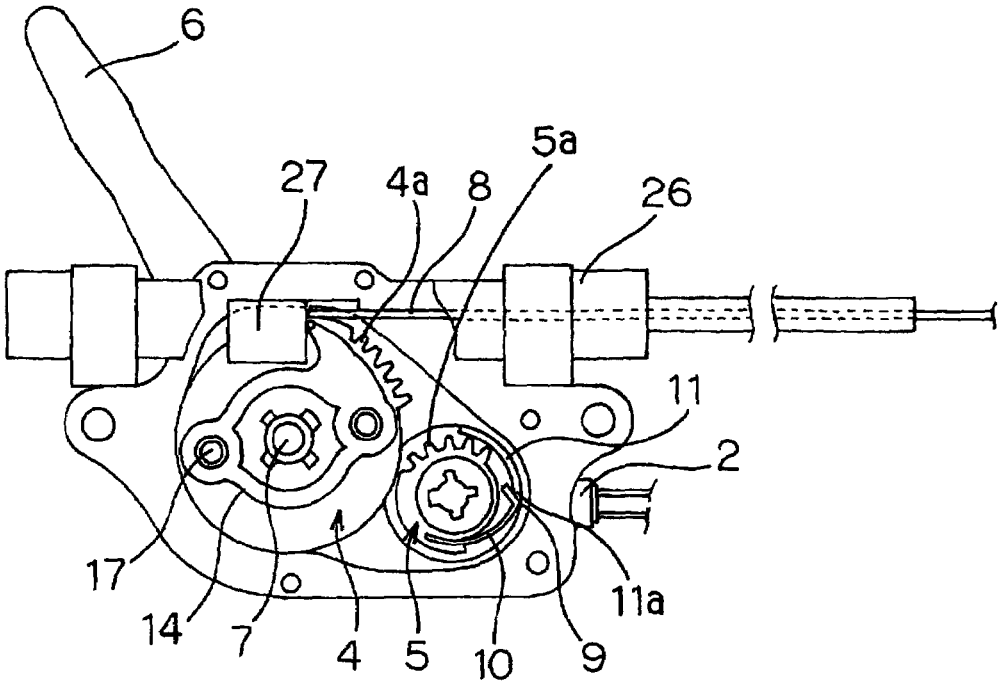
FIG. 9 is a plan view illustrating the internal shape of the same case member as shown in FIG. 6 in a state where the lever is in an intermediate position between the idling position and throttle full-open position.

As shown in FIG. 9, if the lever 6 is turned to the left from the idling position, the arm 28 of the protruding section 14 of the drive gear pulls the throttle wire 8 to the left. Therefore, the engine revolves at a speed higher than that in the idling position. In the position with a speed higher than that in the idling position, the steel balls 17 of the drive gear 4 are released from the latch holes 19*c*, 19*d* of the angle control plate 18 shown in FIG. 11 and move over the surface of the angle control plate 18. Therefore, in this position, the operator can freely select a speed within a range of speeds faster than in the idling position and slower than in the throttle full-open position.

Figure 10:
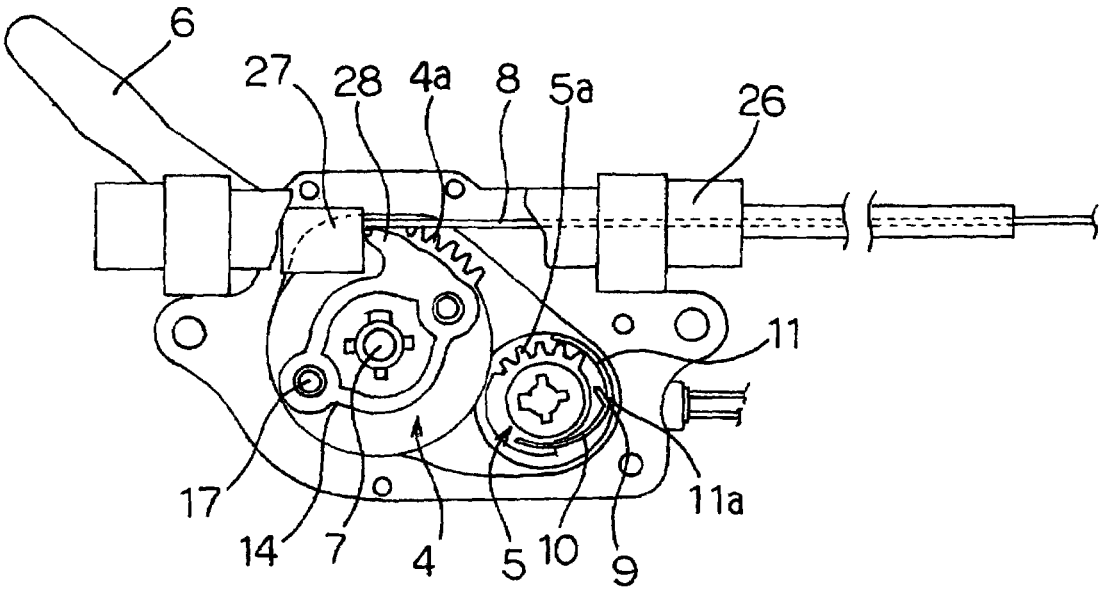
FIG. 10 is a plan view illustrating the internal shape of the same case member as shown in FIG. 6 in a state where the lever is in the throttle full-open position.

If the lever is turned to the leftmost side, as shown in FIG. 10, the arm 28 of the protruding section 14 of the drive gear pulls the throttle wire 8 to the leftmost side, the throttle is fully opened, and the steel balls 17 of the drive gear 4 are fitted into the latch holes 19*e*, 19*f* of the angle control plate 18 shown in FIG. 11. Therefore, a constant throttle full-open speed can be obtained.

As shown in FIGS. 8, 9, 10, in the process of turning the throttle lever 6 from the idling position to the throttle full-open position, the teeth 4*a* of the drive gear 4 are disengaged from the teeth 5*a* of the driven gear 5. Therefore, the driven gear 5 assumes a stop state in which it is not affected by the rotation of the drive gear 4 and the ON state of the engine stop switch 2 and the open state of the fuel open-close cock 3 are maintained.

When the driven gear 5 is in the stop state in which it is not affected by the rotation of the drive gear 4, the driven gear 5 apparently can be independently rotated under the effect of vibrations or impact. Therefore, when the driven gear 5 is stopped, the locking section 9 at the distal end of the plate spring 10 provided on the outer side of the driven gear 5 is engaged with the step 11*a* located between the guiding wall 11 and the case member 1*b*, whereby the unnecessary rotation of the driven gear 5 is prevented and the ON state of the engine stop switch 2 and the open state of the fuel open-close cock 3 are maintained.

In the process of returning the throttle lever 6 from the throttle full-open state shown in FIG. 10 to the engine stop position on the right side, if the drive gear 4 is rotated as far as the idling position shown in FIG. 8, the drive gear 4 becomes engaged with the driven gear 5, and the driven gear 5 starts rotating. At this time, the rotation of the driven gear 5 is prevented by the plate spring 10, but because a force preventing this rotation is due to the engagement of the V-shaped locking section 9 at the distal end of the plate spring 10 with the step 11*a*, the rotation is started under the effect of the rotation force applied from the drive gear 4.

When the lever 6 is turned beyond the idling position to the position shown in FIG. 7, the rotation angle of the driven gear S further advances, whereby the engine stop switch 2 is turned off and the engine is stopped, but the fuel open-close cock 3 is still in the open state. If the lever 6 is further turned into the engine stop position shown in FIG. 6, the engine stop switch 2 is turned off, the fuel open-close cock 3 is closed, and the leak and flow loss of the fuel is prevented.

In the throttle regulator in accordance with the present invention, the engine stop switch and fuel open-close cock are integrally incorporated inside the throttle lever case and the manipulations of opening and closing the engine stop switch and fuel open-close cock are performed by the intermittent rotation of the partially toothless drive gear and driven gear that are rotated by turning the throttle lever. Therefore, the throttle regulator can have a compact shape that could not be attained with the conventional structures and can have a sealed structure ensuring high durability. Moreover it has a structure that can be easily manipulated by an operator.

What is claimed is:

1. A throttle regulator for a vibration compaction machine in which an engine stop switch and a fuel open-close cock are integrally incorporated in a throttle lever case, wherein:

said engine stop switch and fuel open-close cock are disposed so as to be actuated by rotation of a partially toothless driven gear disposed in the lever case, a lever turning shaft located inside the lever case also comprises a partially toothless drive gear that engages intermittently with said partially toothless driven gear, and within a range in which a lever is turned from an engine stop position to an idling position and a range in which the lever is turned from the idling position to the engine stop position, the partially toothless driven gear is rotated by a predetermined angle by the rotation of the partially toothless drive gear, and an opening and closing operation of the fuel open-close cock and an on-off operation of the engine stop switch are performed.

2. The throttle regulator for a vibration compaction machine according to claim 1, wherein within a range in which the lever is turned from the idling position to a throttle full-open position and within a range in which the lever is turned from the throttle full-open position to the idling position, an engagement of a tooth of the partially toothless drive gear and a tooth of the partially toothless driven gear is released, the rotation of the partially toothless driven gear is stopped, and a position in which the engine stop switch is on and the fuel open-close cock is open is maintained.

3. The throttle regulator for a vibration compaction machine according to claim 1, wherein the partially toothless drive gear for intermittent engagement with the partially toothless driven gear is fit onto a lever rotary shaft located inside the lever case, the drive gear is fit on the shaft inside the case so that the lever can be stationary located in predetermined speed regulation positions including an engine stop position and an idling position, and when the lever is turned from the idling position in the direction of a throttle full-open position, an arm provided at the drive gear moves a distal end section of a throttle wire introduced into the case in the turning direction of the lever.

4. The throttle regulator for a vibration compaction machine according to claim 1, wherein the engine stop switch and the fuel open-close cock are provided independently in the case in a removable manner.

5. The throttle regulator for a vibration compaction machine according to claim 2, wherein the partially toothless drive gear for intermittent engagement with the partially toothless driven gear is fit onto a lever rotary shaft located inside the lever case, the drive gear is fit on the shaft inside the case so that the lever can be stationary located in predetermined speed regulation positions including an engine stop position and an idling position, and when the lever is turned from the idling position in the direction of a throttle full-open position, an arm provided at the drive gear moves a distal end section of a throttle wire introduced into the case in the turning direction of the lever.

6. The throttle regulator for a vibration compaction machine according to claim 2, wherein the engine stop switch and the fuel open-close cock are provided independently in the case in a removable manner.

7. A throttle regulator for a vibration compaction machine in which an engine stop switch and a fuel open-close cock are integrally incorporated in a throttle lever case, wherein:

said engine stop switch and fuel open-close cock are disposed so as to be actuated by rotation of a partially toothless driven gear disposed in the lever case, a lever turning shaft located inside the lever case also comprises a partially toothless drive gear that engages intermittently with said partially toothless driven gear, and within a range in which a lever is turned from an engine stop position to an idling position and a range in which the lever is turned from the idling position to the engine stop position, the partially toothless driven gear is rotated by a predetermined angle by the rotation of the partially toothless drive gear and an opening and closing operation of the fuel open-close cock and an on-off operation of the engine stop switch are performed, and within a range in which the lever is turned from the idling position to a throttle full-open position and within a range in which the lever is turned from the throttle full-open position to the idling position, an engagement of a tooth of the partially toothless drive gear and a tooth of the partially toothless driven gear is released, the rotation of the partially toothless driven gear is stopped, and a position in which the engine stop switch is on and the fuel open-close cock is open is maintained.

8. The throttle regulator for a vibration compaction machine according to claim 7, wherein the partially toothless drive gear for intermittent engagement with the partially toothless driven gear is fit onto a lever rotary shaft located inside the lever case, the drive gear is fit on the shaft inside the case so that the lever can be stationary located in predetermined speed regulation positions including an engine stop position and an idling position, and when the lever is turned from the idling position in the direction of a throttle full-open position, an arm provided at the drive gear moves a distal end section of a throttle wire introduced into the case in the turning direction of the lever.

9. The throttle regulator for a vibration compaction machine according to claim 7, wherein the engine stop switch and the fuel open-close cock are provided independently in the case in a removable manner.

10. A throttle regulator for a vibration compaction machine having a structure in which a base end section of a circular-arc plate spring comprising a V-shaped locking section at a distal end thereof is fixed to an outer peripheral surface of a partially toothless driven gear for actuating an engine stop switch and a fuel open-close cock, a circular-arc guiding wall is provided on the inner surface of a case along the outer peripheral surface of the partially toothless driven gear, when the engagement of a tooth of a partially toothless drive gear and a tooth of the partially toothless driven gear is released and the rotation of the partially toothless driven gear is stopped, the V-shaped locking section located at the distal end of the plate spring is engaged with a step formed by an end section of the circular-arc guiding wall and the inner surface of the case and the independent rotation of the partially toothless driven gear can be prevented.

11. A throttle regulator for a vibration compaction machine having a structure in which a partially toothless drive gear that is rotated by a lever is supported on a rotary shaft inside a case member via a latch structure in which a steel ball protruding at one side surface is fit and pushed into a latch hole on an inner surface of the case by a spring pressure, a pushing force of the spring acting on said steel ball is provided by sandwiching the rotary shaft between left and right case members, whereas a tightening force necessary for the turning operation of the lever that is fit onto a rotary shaft is provided to the lever via a force by which a bolt-head screwed into a rotary shaft pushes a disk spring.

* * * * *